United States Patent [19]

Sudarshan et al.

[11] Patent Number: 4,780,176

[45] Date of Patent: Oct. 25, 1988

[54] METHOD OF WETTING METALS

[75] Inventors: Tangali S. Sudarshan, Columbia; Larry Park, West Columbia; Meng H. Lim; James E. Thompson, both of Columbia, all of S.C.

[73] Assignee: University of South Carolina, Columbia, S.C.

[21] Appl. No.: 510,088

[22] Filed: Jun. 30, 1983

[51] Int. Cl.[4] ..... B44C 1/22; C03C 15/00

[52] U.S. Cl. ..... 156/643; 156/645; 156/651; 156/664; 427/38; 427/307; 427/328

[58] Field of Search ..... 427/38, 307, 328; 156/643, 645, 651, 664

[56] References Cited

U.S. PATENT DOCUMENTS 2,410,844 11/1946 Signaigo et al. ..... 117/130
4,306,906 12/1981 Anderson ..... 75/134

FOREIGN PATENT DOCUMENTS 509965 7/1939 United Kingdom .

OTHER PUBLICATIONS

Barlow et al., "The Wetting of Metal Surfaces by Liquid Mercury", vol. 60 No. 10, Zeitschrift Fhur Metalkunde 817-820 (1969).

Wright et al., "Pulse Modulator Behavior of the Liquid Metal Plasma Valve (LMPV)", U.S. Army Research & Development Technical Report, ADA 064881, Fort Monmouth, N.J. 07703.

Bayless et al., "The Liquid Metal Plasma Valve Closing Switch", Naval Surface Weapons Center Technical Report, ADA 042676, Silver Spring, Md. 20910.

*Primary Examiner*—Bernard D. Pianalto
*Attorney, Agent, or Firm*—Brumbaugh, Graves, Donohue & Raymond

[57] ABSTRACT

A method of wetting and coating various metals, which have been mechanically polished and chemically cleaned and etched, includes plasma cleaning and etching the metal and delivering mercury or other liquid metals through the plasma to the surface of the metal to be wetted. Tungsten, molybdenum, steels and elkonite are among the metals which may be wetted with a liquid metal according to the method of this invention. Molybdenum is cleaned and etched in a solution of 2-propanol and $H_2O_2$.

7 Claims, 2 Drawing Sheets

RECOMMENDED TIME OF ETCHING FOR DIFFERENT PROPORTIONS OF HYDROGEN PEROXIDE/2-PROPANOL USED TO ETCH MOLYBDENUM

METHOD OF WETTING METALS

The invention herein was supported by the University of South Carolina and by the National Science Foundation under Grant No. CPE-8024712. Both the University of South Carolina and the U.S. Government have rights to the invention.

BACKGROUND OF THE INVENTION

This invention relates to a method of wetting metals with mercury and other liquid metals.

The wetting of metal surfaces with liquid metals has far-reaching practical significance. Wetted metals are useful in the development of high power and high current switches which are important in pulse power applications such as lasers, fusion, isotope separation, intense ion beams, etc. High current switches are used in applications such as metal deposition of optical lenses. Liquid metals are also employed as contacts in rotating machinery, stationary and sliding liquid metal contacts, high energy storage devices, and mirrors used in surveying and mapping.

In high power applications, a switch should be able to withstand high voltages of from 10 kV to hundreds of kV before switching. The switches should also be capable of high current conduction (from tens to hundreds of kilo-amperes) and high coulomb (charge) transfer per shot after switching. The switches should perform reliably over many operations and have a high repetition rate.

Unfortunately, high current switch conduction results in severe erosion of the electrode materials. Switching devices have a short lifetime at normal operating levels because the voltage hold-off drops significantly due to electrode erosion. However, oblation and melting of the electrodes can be reduced or prevented if the electrodes are coated with a material such as mercury or other liquid metals. When the switch conducts, the needed carriers are provided by the vaporized layer of liquid metal. This prevents oblation of the switch electrodes and extends their lifetime.

Energy storage capacitors which are capable of storing very high energies are required for various pulse power applications and for other uses as well. Typically, these capacitors consist of electrodes separated by an insulating medium. The stored energy can be increased by increasing the voltage difference between the two electrodes. This, in turn, increases the stress between the electrodes. If the stress exceeds certain critical levels, a breakdown of the gap results. Protrusions on the electrode surface result in stress enhancement above the average stress in the gap. Therefore, it is essential to have smooth electrode surfaces. Such surfaces can be obtained by coating the electrodes with a liquid metal, resulting in capacitors having increased energy storage capability.

Mercury coated surfaces are useful in surveying and mapping. Mercury pools are used as horizontal mirrors in astrolabes and photographic zenith tubes. The containers commonly used are made of copper and tin-coated copper and as a result, the mercury pool must be frequently cleaned due to contamination. Therefore, ideal containers are those which have been wetted with mercury and which do not introduce any contaminants into the pool.

Liquid metals are also useful in heat pipes, where they efficiently conduct heat. Since mercury is not easily corroded and has a high heat transfer rate (between 200° and 400° C.), it is well-suited for use as heat pipe fluid.

Mercury and other liquid metals may also be employed in sliding liquid contacts and high current switches used in such applications as vacuum metal deposition of optical components. Wetting the switch contacts with liquid metals reduces power losses due to contact resistance. Mercury and other liquid metals, particularly sodium and potassium, are also utilized as slipring current collectors in homopolar machines. Power losses resulting from solid metal contact resistance can be reduced by wetting the metal surface with the liquid metal.

It is known that mercury can wet not only metals which are soluble in mercury, such as platinum, silver and copper, but also metals which are insoluble in mercury, such as iron, nickel, molybdenum and tungsten. Barlow et al., "The Wetting of Metal Surfaces by Liquid Mercury," Vol. 60 No. 10, Zeitschrift Fhur Metalkunde 817–20 (1969). As discussed by Barlow et al., it is believed that a solid surface is wetted by a liquid when the advancing contact angle, $\theta$, is zero or very neary zero. The contact angle refers to the angle measured through the liquid between the plane surface of the solid and the tangent to the liquid drawn from the point of intersection of the solid, liquid and vapor phases. When a liquid wets a solid surface and spreads upon it at a rate determined by its viscosity and the surface roughness, then $\theta=0$.

Barlow et al. wetted various metals with mercury by mechanically and chemically cleaning and polishing the metal surfaces, further cleaning the metals by bombarding the surfaces with argon ions, and then dropping mercury onto the surface of the metal. Because this method did not achieve the desired degree of wetting, Barlow et al. followed the above-recited procedure by further bombarding the mercury-covered metal with argon ions. However, if the time that elapses between the cessation of the argon ion bombardment and the delivery of mercury onto the substrate surface increases, the contact angle increases significantly. Moreover, even when the second ion bombardment immediately follows the addition of the liquid metal to the surface of the metal substrate, the substrate is wetted only around the rims of the mercury drops, and not the entire surface of the metal covered by the liquid metal drop, since the ion bombardment is blocked by the drops themselves and the substrate cannot be further etched beneath the drops. Thus, when the metal substrate is shaken, the drops fall off and wetting is observed only at the junction of the mercury drops and the vapor phases.

It is an object of the instant invention to provide a new and improved method of wetting metals with mercury and other liquid metals which covers the entire surface of a metal substrate with a durable liquid metal coating.

SUMMARY OF THE INVENTION

In accordance with the present invention, there is provided a method of wetting and coating various metals, which have been mechanically polished and chemically cleaned and etched, which includes plasma cleaning and etching the metal in a gas such as argon, air or nitrogen, and delivering mercury or other liquid metals to the surface of the metal through the plasma. The method of this invention causes the surface of the metal to become extremely clean and uniformly etched, thus enhancing the surface area of the metal and permitting the complete spontaneous wetting of the metal, i.e., a zero contact angle is attained. This invention may be employed to wet any pure metal or alloy, such as tungsten, steels, molybdenum, and elkonite. In addition to mercury, it is believed that other liquid metals such as sodium, potassium, gallium, indium, sodium-potassium eutectics and gallium-indium eutectics may also be used.

For a better understanding of the invention, together with other and further objects, reference is made to the following description, taken in conjunction with the accompanying drawings.

DETAILED DESCRIPTION OF THE EMBODIMENTS

The method of this invention may be employed to wet any pure metal or alloy. When tungsten has been wetted with mercury, the metal becomes more useful in switches, capacitors and the other applications of wetted metals described above. In wetting tungsten according to the method of this invention, the metal was first mechanically polished with 25 micron alumina on a wheel. However, any standard means of mechanically cleaning and polishing the metal may be employed.

The tungsten was then chemically treated to remove contaminants such as grease, oxide and other characteristic layers, and also to etch the surface so as to increase the surface area of the metal. Increasing the surface area of the metal to be wetted increases its surface energy and enhances both the wetting and spreading of the liquid metal which is applied. Tungsten was chemically treated by placing the metal in a solution of 30% $H_2O_2$+30% $H_2SO_4$ for ten minutes. This was followed by chemical etching in 1:1 HF for ten minutes. Thereafter, the metal was chemically etched in $K_3Fe(CN)_6$-:NaOH solution for five minutes. Each of these three etchings were performed in an ultrasonic bath at room temperature. Although this procedure effectively removed contaminants from the surface of the tungsten metal and also etched the surface to increase its surface area, any other standard chemical pretreatment may also be used to clean and etch the metal surface.

Figure 1:
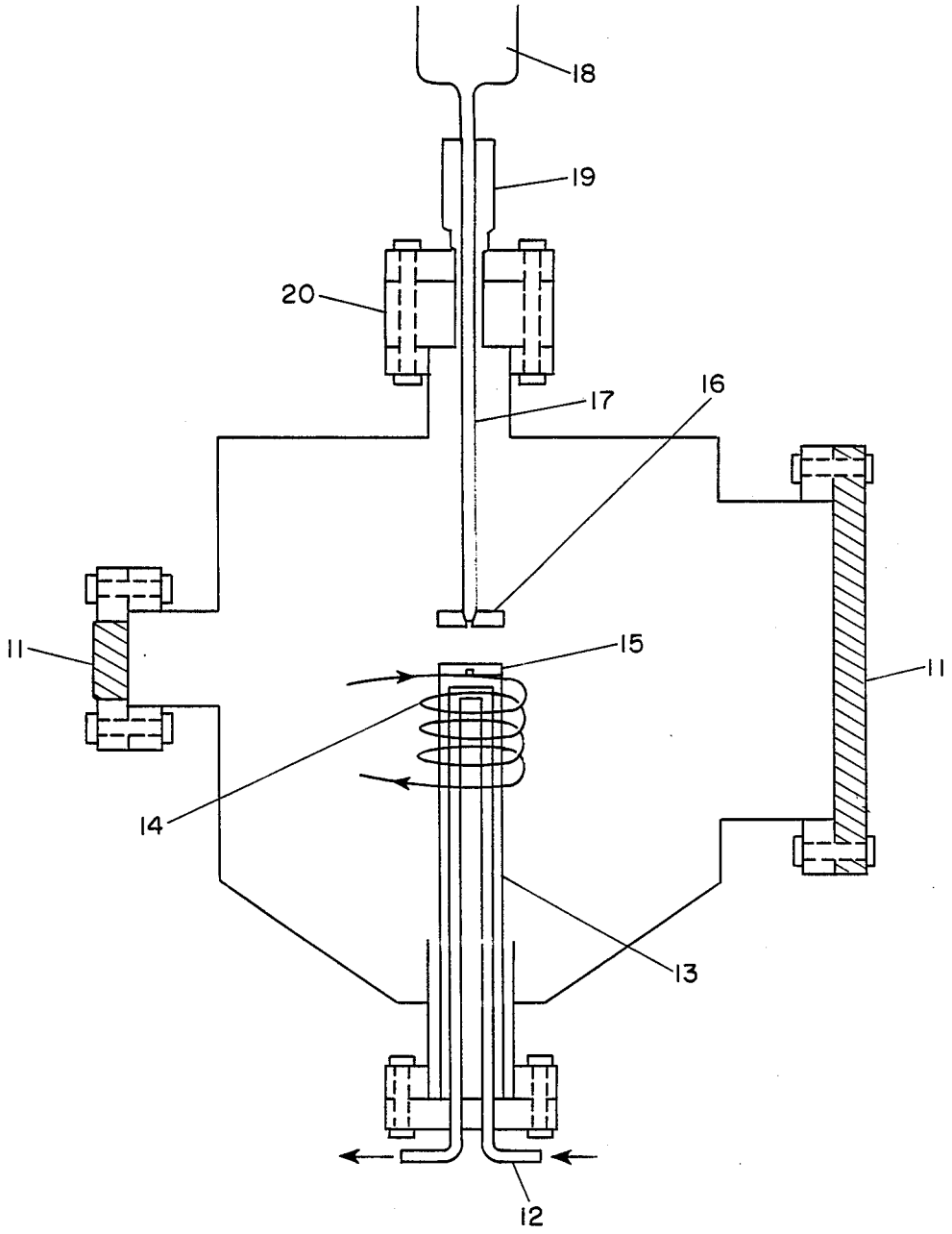
FIG. 1 is a front cross section of a chamber for plasma etching metals and delivering mercury or other liquid metals through the plasma to the metal surfaces.

After chemical treatment, the tungsten was rinsed in a solution of isopropyl alcohol and transferred to the chamber 10 of FIG. 1. The chamber 10 contains a gas such as argon, air or nitrogen, and is equipped with a mercury diffusion pump and a liquid nitrogen cold trap (not shown). Two viewing ports 11 enable visual observation, contact angle measurements and photography. A cooling tube 12 permits coolant to run through the metal specimen support structure 13; and a copper coil 14 permits radio frequency heating of the metal specimen substrate 15. An electrode 16 is suspended by a hollow stainless steel rod 17 which is connected to a liquid metal reservoir 18.

In the chamber 10, metal specimen substrates are plasma etched by applying a voltage between the substrate 15 and the electrode 16 arranged in a parallel plane configuation. Plasma etching takes place when a highly ionized gas bombards the surface of a metal so as to clean the metal by removing oxide and other adsorbed layers, thus rendering the substrate uniformly etched for liquid metal wetting. The gas may be any gas, but argon or air are preferable. The electrode gap spacing can be varied by supporting the electrode 16 on a rotary motion feed-through 19. The pressure of the gas inside the chamber which is used for the plasma etching can be varied by a regulating needle valve (not shown). Using a vacuum-tight syringe, liquid metal drops can be delivered to the specimen surface in situ vacuum.

After the tungsten specimen was transferred to the chamber 10, the chamber was evacuated to $10^{-3}$ torr. The metal was then heated to approximatley 150° C. for 15 minutes. The heating may be by radio frequency induction or by any other suitable technique. The metal was then plasma etched by bombardment with argon ions for 10 minutes by applying a 3 kV potential difference across the gap between the metal 15 and the electrode 16.

The argon plasma contained air, and accordingly, oxygen. Plasma etching was also achieved in a pure air environment, which necessarily contained oxygen. If nitrogen is the gas of choice, the plasma discharge should also contain air or oxygen. It is believed that the oxygen in air enhances etching and that plasma etching not only cleans the surface of the metal to be wetted, but also excites the atoms on the surface of the metal, thereby making the metal surface more chemically reactive to mercury and other liquid metals.

After plasma etching, mercury was delivered to the hot surface of the tungsten through the plasma. The delivery of the liquid metal through the plasma onto the surface of the metal to be wetted is an important feature of this invention. When a liquid metal is dropped through the plasma, it is also in an excited (reactive) state. Hence, it is believed that the nascent species, created both on the substrate surface and in the liquid metal) are reactive, and therefore more compatible to form complexes. Further, due to their reduced radii, the $Hg^{2++}$ ions may form complexes with the atoms of the substrate because of the reduced atomic radius ratio. This invention also permits the liquid metal to be applied to a surface which is extremely clean due to uniform cleaning and etching.

If necessary, the wetted metal may be cooled by passing a coolant through the support platform 13. When the above procedure was followed with a tungsten substrate, a zero contact angle was attained. A mercury film was formed on the tungsten surface when the excess mercury was removed.

Any steel (e.g. low carbon steel, mild steel, high carbon steel or stainless steel) can be weted by liquid mercury or other liquid metals according to the method of this invention. Mercury coated steel is useful in any of the applications described above.

Stainless steel was wetted according to this invention by first polishing the metal to a 25 micron finish. As heretofore noted, any standard means of mechanically polishing the metal is acceptable. The steel was then chemically etched for 10 minutes in a solution of 50 parts HCL (volume), 7 parts H and 18 parts water in an ultrasonic cleaner. It was then rinsed twice in deionized water. Thereafter, the metal was etched for 10 minutes in a solution of 8.25 grams $K_3Fe(CN)_6$ and 2 grams NaOH in 100 ml water. This treatment was followed by two rinsings with deionized water and the steel was then dried. Although this method of chemically cleaning and etching the steel removed grease and other characteristic contaminants from the surface, any other standard chemical pretreatment may be employed.

After the steel was chemically cleaned and etched, it was transferred to the chamber 10 which was evacuated as noted above. The steel was plasma etched for 10 minutes according to the same procedure employed in the tungsten plasma etching and mercury was dropped through the plasma to wet the metal. Mercury spread completely upon the surface of the steel to produce a contact angle of zero. Removal of excess mercury resulted in a film of mercury on the steel substrate.

Molybdenum can also be wetted with a liquid metal according to the method of this invention. Mercury covered molybdenum can be used in all of the applications mentioned above. In order to wet molybdenum, the metal was first polished to a 25 micron finish in the same manner that tungsten and steel were mechanically prepared. As heretofore noted, however, any standard means of mechanically polishing the metal is acceptable.

Figure 2:
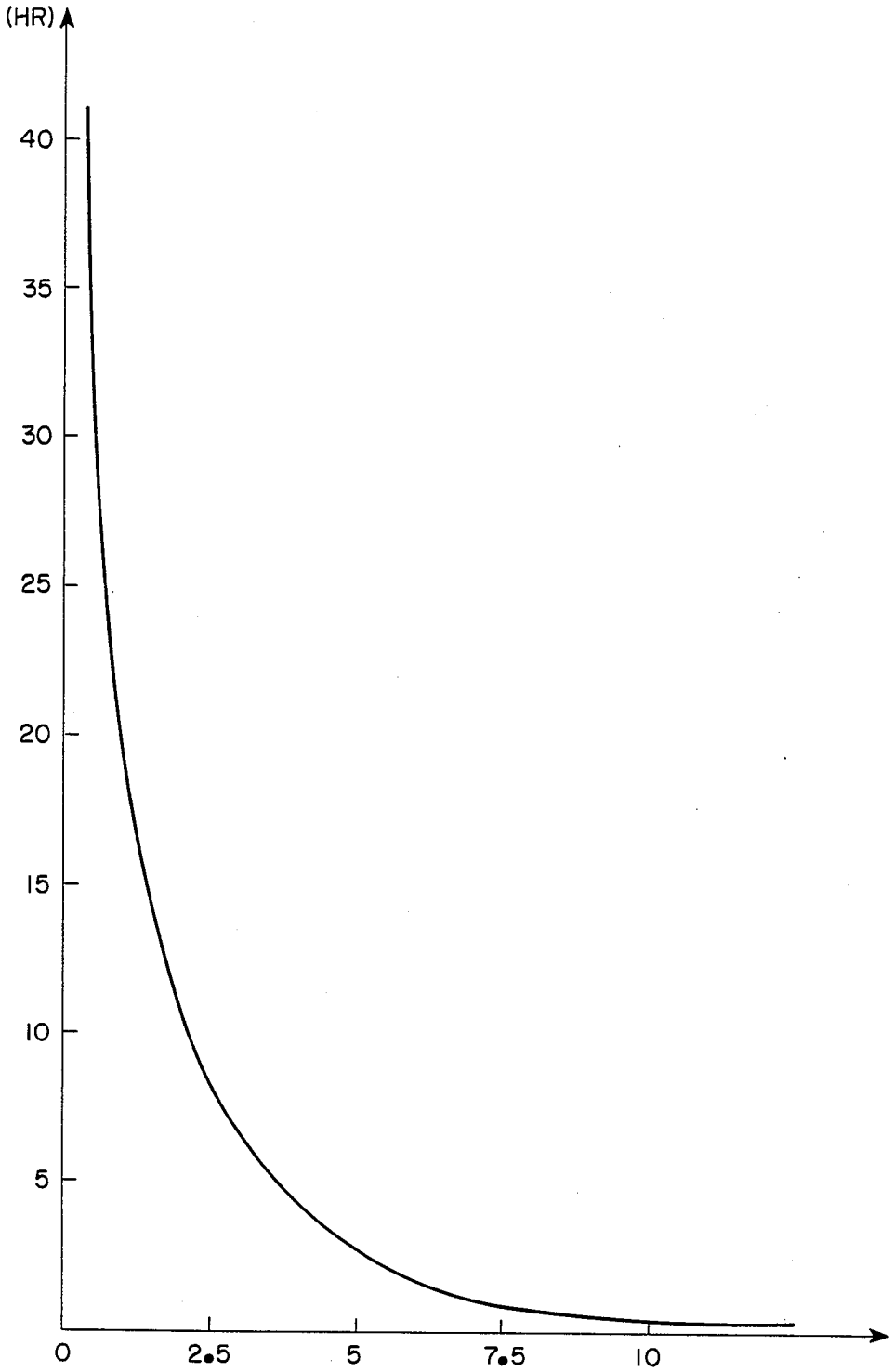
FIG. 2 is a plot of the concentration of $H_2O_2$ in 2-propanol as a function of time to attain uniform chemical etching of molybdenum.

After mechanical polishing, the molybdenum was treated in a solution of 2-propanol and $H_2O_2$. Surprisingly, this resulted in both the cleaning and etching of the metal. The degree of chemical etching was dependent on the concentration of $H_2O_2$, and also the duration of treatment. FIG. 2 qualitatively shows a plot of the concentration of $H_2O_2$ in 2-propanol as a function of time to attain a certain degree of uniform chemical etching. The surface of molybdenum turns dark if it is over-etched. This novel method of chemically etching molybdenum is simple and very effective. However, molybdenum may also be cleaned and etched by any standard chemical pretreatment.

After chemical etching, the molybdenum was rinsed in water, dried and plasma etched for ten minutes according to the same procedures heretofore described. Thereafter, mercury was dropped through the plasma onto the molybdenum. The mercury spread spontaneously to yield a zero contact angle. Excess mercury was carefully removed, leaving a film that appeared to make intimate contact with the substrate.

This invention was also employed to wet elkonite (70% tungsten, 30% copper) which can be used as electrodes, contacts in switches, and in the other applications described above. The metal was polished on a wheel using 10 micron alumina powder. Thereafter, the elkonite was chemically cleaned and etched by rinsing the metal in deionized water and treating it in a 1:50 solution of $H_2O_2$ in 2-propanol for 15 minutes. Like the other metal substrates described above, elkonite can be mechanically and chemically pretreated according to any other standard method.

After chemical pretreatment, the elkonite was rinsed in water and transferred to the chamber 10 which was evacuated to below 50 microns. Argon gas was employed for plasma etching and the pressure was 1,000 microns. The electrode gap was 5 mm, the gap voltage was 250 volts and the current was 60 mA. The elkonite was plasma etched for approximately 10 minutes. Mercury was then delivered through the plasma and the plasma was turned off. The metal was cooled and the contact angle was found to be less than 5°. A mercury film was left on the metal surface when the excess mercury was removed, producing a zero contact angle. The elkonite was spun at 1,700 rpm for a few minutes and fresh mercury was added to the surface. The above procedure was repeated many times and the coating remained intact. The strong adhesion of mercury to the substrate suggests that an amalgam forms between mercury and the copper in elkonite.

In each of the embodiments heretofore described, mercury was employed to wet the respective metal substrates. As noted above however, it is believed that other liquid metals such as sodium, potassium, gallium, indium, sodium-potassium eutectics and gallium-indium eutectics may also be used to wet and coat any pure metal or alloy, although the use of such other liquid metals may require a modification of the plasma etching parameters described herein.

While representative applications and embodiments of the invention have been described, those skilled in the art will recognize that many variations and modifications of such embodiments may be made without departing from the spirit of the invention, and it is intended to claim all such variations and modifications as fall within the true scope of the invention.

We claim:

1. In a method of wetting a metal in a chamber with a liquid metal, said method including steps wherein the metal to be wetted is mechanically polished and chemically cleaned and etched;

the improvement comprising (1) plasma cleaning and etching the metal and (2) dropping a liquid metal from a source at one position in the chamber through the plasma to the surface of the metal to be wetted; wherein said metal to be wetted is at another position in the chamber.

2. The improvement according to claim 1 wherein said liquid metal is selected from the group comprising mercury, sodium, potassium, gallium, indium, sodium-potassium eutectic and gallium-indium eutectic.

3. The improvement according to claim 1 wherein the metal to be wetted is selected from the group comprising tungsten, molybdenum, elkonite, low carbon steel, mild steel, high carbon steel, and stainless steel.

4. The improvement according to claim 1 wherein said plasma etching is performed in a chamber containing a gas selected from the group comprising (a) air, (b) argon and air, (c) argon and oxygen, (d) nitrogen and air, and (e) nitrogen and oxygen.

5. The improvement according to claim 1 wherein the metal is cooled after wetting.

6. A method of cleaning and etching molybdenum which comprises treating molybdenum in a solution of 2-propanol and $H_2O_2$.

7. A method according to claim 6 wherein the concentration of 2-propanol is greater than the concentration of $H_2O_2$.

* * * * *

UNITED STATES PATENT AND TRADEMARK OFFICE

CERTIFICATE OF CORRECTION

PATENT NO. : 4,780,176

DATED : October 25, 1988

INVENTOR(S) : Tangali S. Sudarshan et al.

It is certified that error appears in the above-identified patent and that said Letters Patent is hereby corrected as shown below:

Col. 2, line 23, "neary" should read --nearly--;

Col. 4, line 54, "weted" should read --wetted--;

Col. 4, line 63, "H" should read --$H_2SO_4$--.

Signed and Sealed this

Fourteenth Day of February, 1989

*Attest:*

DONALD J. QUIGG

*Attesting Officer*

*Commissioner of Patents and Trademarks*